United States Patent [19]

Yates

[11] 4,190,183

[45] Feb. 26, 1980

[54] HAND GUN CASE

[76] Inventor: Donald Yates, 4538 W. Knox, Tampa, Fla. 33614

[21] Appl. No.: 950,136

[22] Filed: Oct. 10, 1978

[51] Int. Cl.[2] ..... F41C 33/02

[52] U.S. Cl. ..... 224/238; 224/235; 224/911; 2/DIG. 6

[58] Field of Search ..... 224/2 B, 2 C, 2 D, 2 E, 224/2 F, 2 G, 2 A, 26 R, 26 B, 5 R, 5 A, 5 B, 5 C, 26 D, 26 K, 5 H, 235, 238, 911; 2/DIG. 6; 24/204

[56] References Cited

U.S. PATENT DOCUMENTS

| | | | |
|---|---|---|---|
| 146,232 | 1/1874 | Clarke | 224/26 K X |
| 2,072,352 | 3/1937 | Wyland | 224/26 D UX |
| 2,349,376 | 5/1944 | Ray | 224/2 B |
| 2,590,187 | 3/1952 | Langos | 224/2 B |
| 3,269,620 | 8/1966 | DuBois | 224/2 B |
| 3,854,639 | 12/1974 | Genchi | 224/26 B |

*Primary Examiner*—Jerold M. Forsberg
*Attorney, Agent, or Firm*—Arthur W. Fisher, III

[57] ABSTRACT

A hand gun case for storage of a pistol comprising a main body having an opening formed at the upper portion thereof to form a pocket or enclosure to receive and house the pistol and a closure flap movable between an open and closed position extending outwardly from the main body adjacent the opening to enclose the pistol within the hand gun case when in the closed position in combination with a first closure element including a first and second member formed on the main body and closure flap respectively and a second closure element formed on the main body to selectively secure the closure flap in the closed position.

4 Claims, 2 Drawing Figures

HAND GUN CASE

BACKGROUND OF THE INVENTION

1. Field of the Invention

A hand gun case comprising a main body forming a pocket and a closure flap to store a pistol.

2. Description of the Prior Art

A number of holsters have been designed to carry firearms, attached to the body by means of a belt, or carried lossely. These holsters are generally provided with a leather strap or other means closing over the handle of the weapon by means of a clasp, button, or the like.

U.S. Pat. No. 1,827,182 shows a simple holster for firearms and the like, where the weapon may be rapidly and conveniently placed in the holster and, when so placed, will be firmly held against accidental displacement or discharge, while rapid withdrawal is assured.

U.S. Pat. No. 3,269,620 relates to cases or holsters for carrying articles such as hand guns and the like on a waist belt or shoulder. The article may be carried either at a high position close to the body when the case is closed or at a low-slung more accessible position when the case is open. More particularly, the carrying cases or holsters is supported from the waist belt or shoulder strap of a carrier with means for moving the case downwardly from the supporting belt or strap to a low-slung position when the case is opened in order to provide better accessibility for removing or returning the encased article.

U.S. Pat. No. 1,110,993 relates essentially to a guard-pad composed of felt and mounted within a woven holster upon one wall adjacent the position occupied by the exposed head of the latching-pin for the cartridge-magazine of an automatic pistol contained within the holster. The felt guard-pad holds the pistol and the wall of the holster away from each other so that the head is out of contact with the wall. Further, it shields the latching-pin to prevent the pin from accidentally being adapted by contact with the wall of the holster to unlatch and release the magazine.

Other efforts have been undertaken to design means for storage of hand guns. Commonly known as gun rugs, these often comprise cases having zippers or the like to fully encase the weapons. Unfortunately these do not permit easily access to the hand gun itself.

SUMMARY OF THE INVENTION

The present invention relates to a hand gun case to store a hand gun. More specifically the hand gun case comprises a main body and closure flap.

The main body comprises a forward and rear panel. The closure flap, movable between an open and closed position, extends outwardly from the rear panel adjacent the opening formed between the forward and rear panels to enclose the pistol within the hand gun case when in the closed position. The closure flap is configured similarly to the main body. In this configuration, the outline of the closure flap overlies or registers with the outline of the main body when the hand gun case is closed.

The hand gun case further includes a first closure element comprising a first and second member formed on the forward panel and closure flap respectively. The first and second members may comprise a velcro or hook and loop type fastners. A secondary flap is disposed below the first member such that is may be tucked under the second closure element. The second closure element comprises a strap extending across the front panel. The diagonal strap is located adjacent to and below the first closure element on the forward panel and at the same time permits hand room for insertion between the front panel and closure flap when the closure flap is in the closed position.

When the tip of closure flap is placed between the strap and main body and pulled downward, the first and second members become engaged to prevent the hand gun from accidentally falling when held in the upside down position.

As an option, when the hand gun is stored in home or office for security purposes, the secondary flap can be placed between the first and second members rendering them ineffective. This would allow fast and quiet access to gun in an emergency.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
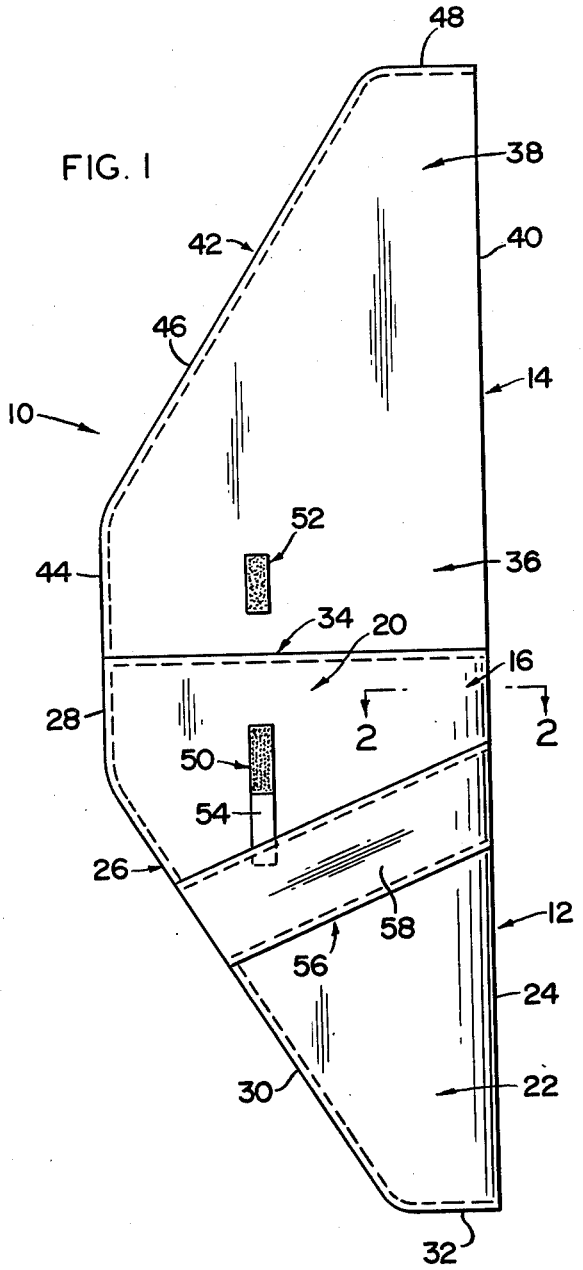
FIG. 1 is a front view of the hand gun case in the open position.
Figure 2:
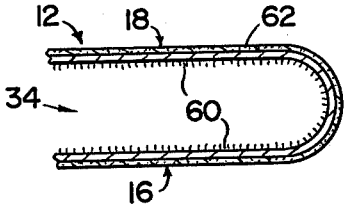
FIG. 2 is a partial cross-sectional view of the hand gun case.

As shown in FIG. 1, the present invention relates to a hand gun case generally indicated as 10 to store a hand gun. The hand gun case 10 comprises a main body and closure flap generally indicated as 12 and 14 respectively.

The main body 12 comprises a forward and rear panel 16 and 18 respectively forming an enlarged upper portion 20 and a tapered, reduced lower portion 22 such that the forward edge 24 comprises a substantially straight line while the rear edge 26 comprises a straight rear portion 28 substantially parallel to the forward edge 24 and an angular portion 30 extending downward to tip or end 32.

The closure flap 14, movable between an open and closed position, extends outwardly from the rear panel 18 adjacent the opening 34 formed between the forward and rear panels 16 and 18 to enclose the pistol within the hand gun case 10 when in the closed position. The closure flap 14 is configured similarly to the main body 12 comprising an enlarged portion 36 and tapered, reduced portion 38 such that the forward edge 40 comprises a substantially straight line with the forward edge 24 while the rear edge 42 comprises a straight rear portion 44 substantially parallel to the forward edge 40 and an angular portion 46 extending to tip or end 48. In this configuration, the outline of the closure flap 14 overlies or registers with the outline of the main body 12 when the hand gun case 10 is closed.

The hand gun case 10 further includes a first closure element comprising a first and second member 50 and 52 respectively formed on the forward panel 16 and closure flap 14 respectively. The first closure member 50 is located on the forward panel 16 such as to register with the butt or grip of the pistol or hand gun disposed within the main body 12 in itself. The first and second members 50 and 52 may comprise a velcro or hook and loop type fastners. A secondary flap 54 is disposed below the first member 50 such that is may be tucked under the second closure element 56. The second closure element generally indicated as 56 is formed on the forward panel 16. The second closure element 56 comprises a strap 58 extending between the forward edge 24 at a point opposite the intersection of the upper and lower portions 20 and 22, and extends diagonally downward to the midportion the angular portion 30. The diagonal strap 58 is located adjacent to and below the first closure element 50 on the forward panel 16 and at the same time permits hand room for insertion between the front panel 16 and closure flap 14 when the closure flap 14 is in the closed position. The closure flap 14, strap 58 and main body 12 may comprise leather or a vinyl like material. The inside of the main body 12 is lined with artificial sheep skin 60. The lining 60 may be backed with felt 62 or other soft material or tufflex impregnated with silicones to serve as added padding and moisture displacement. Flap and strap can be decoratively stitched for appearance and personalization.

When the tip 48 of closure flap 14 is placed between the strap 58 and main body 12 and pulled downward, the first and second members 50 and 52 become engaged to prevent the hand gun from accidentally falling when held in the upside down position.

As an option, when the hand gun is stored in home or office for security purposes, the secondary flap 54 can be placed between the first and second members 50 and 52 rendering them ineffective. This would allow fast and quiet access to gun in an emergency.

The use of the closure flap 14 eliminates positive air tight sealing of the main body 12 allowing ventilation to aid in the prevention of condensation build-up inside main body 12.

It should be noted that the first closure element requires a vertical separation between the two members 50 and 52 while the second closure element or strap 58 requires a slipping or longitudinal action thus essentially in combination interlocking the two. Further note that the diagonal location of the strap essentially coincides with the greatest dimension or bulk of the hand gun forward of the grip or butt.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A hand gun case for storage of a pistol comprising a main body having an opening formed in the upper portion thereof to form a pocket or enclosure to receive and house the pistol and a closure flap movable between an open and closed position extending outwardly from said main body adjacent said opening to enclose the pistol within the hand gun case when in said closed position, a first closure element including a first and second member formed on said main body and said closure flap respectively to secure said closure flap in said closed position when said first and second members are operatively engaged to each other, said first closure element further includes a secondary flap movable between a first and second position to selectively render said first closure element inoperative when in said second position, and a second closure element formed on said main body to selectively secure said closure flap in said closed position, said secondary flap being secured to said main body adjacent said first member such that a portion of said secondary flap normally unlies said second closure element to retain said secondary flap in said first position and disposed between said first and second members when in said second position.

2. The hand gun case of claim 1 wherein said second closure element comprises a diagonally disposed strap extending between the forward edge of said main body and the midportion of the rear edge of said main body.

3. The hand gun case of claim 1 wherein said main body comprises an enlarged upper portion having substantially parallel front and rear edges and a tapered, reduced lower portion such that the forward edge of said main body comprising a substantially straight line and the rear edge of the upper portion and the rear edge of said lower portion are disposed angularly relative to each other.

4. The hand gun case of claim 3 wherein said closure flap includes an enlarged upper portion and tapered, reduced portion to register with said main body when said closure flap is in said closed position.

* * * * *